US007651342B1

(12) United States Patent
Wu

(10) Patent No.: US 7,651,342 B1
(45) Date of Patent: Jan. 26, 2010

(54) DUAL-INTERFACE ELECTRICAL CONNECTOR WITH ANTI-CROSSTALK MEANS THEREBETWEEN

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/321,088

(22) Filed: Jan. 12, 2009

(51) Int. Cl.
*H01R 12/00* (2006.01)

(52) U.S. Cl. ..... 439/76.1; 439/607.46; 439/941

(58) Field of Classification Search ..... 439/76.1, 439/607.06, 607.35, 607.36, 607.37, 607.46, 439/607.56, 941
See application file for complete search history.

(56) References Cited

U.S. PATENT DOCUMENTS 5,219,294 A 6/1993 Marsh et al.
5,873,743 A * 2/1999 Tkazyik et al. ..... 439/76.1
6,343,957 B1 * 2/2002 Kuo et al. ..... 439/76.1
6,663,437 B2 * 12/2003 Korsunsky et al. ..... 439/76.1
6,739,910 B1 5/2004 Wu
7,029,290 B2 * 4/2006 Wu ..... 439/76.1
7,134,914 B1 11/2006 Wu
2004/0038564 A1 * 2/2004 Yan ..... 439/76.1

OTHER PUBLICATIONS

"PCI Express External Cabling Specification, Version 1.0" published on Dec. 6, 2005 by PCI-SIG.

* cited by examiner

*Primary Examiner*—Tho D Ta
(74) *Attorney, Agent, or Firm*—Wei Te Chung; Andrew C. Cheng; Ming Chieh Chang

(57) ABSTRACT

A electrical connector (100) includes a housing including a first shield part (1) assembled to a second shield part (2) to form a receiving space, said receiving space including a hollow portion and a mating port located in front of the hollow portion;

a first and second printed circuit boards (31, 32) accommodated in the receiving space, both the first and second printed circuit boards having mating interfaces extending into the mating port and terminating portions located within the hollow portion; a spacer (4) disposed between the first and second printed circuit boards; and a sheet metal (8) enclosed in the spacer, and said sheet metal having two tabs (811, 812) formed thereon and electrically connected to the first and second printed circuit boards, respectively.

19 Claims, 7 Drawing Sheets

DUAL-INTERFACE ELECTRICAL CONNECTOR WITH ANTI-CROSSTALK MEANS THEREBETWEEN

FIELD OF THE INVENTION

The present invention generally relates to a dual-interface electrical connector, and more particularly to a dual-interface electrical connector having anti-crosstalk means therebetween. This invention relates to the copending application Ser. No. 12/218,862 having the same inventor and the same assignee with the instant invention.

DESCRIPTION OF PRIOR ART

PCI Express, officially abbreviated as PCI-E or PCIe, is a computer expansion card interface format introduced by Intel in 2004. It was designed to replace the general-purpose PCI expansion bus, the high-end PCI-X bus and the AGP graphics card interface. Unlike previous PC expansion interfaces, rather than being merely a bus, it is configured around point-to-point full duplex serial links called lanes. In PCIe 1.1 (the most common version as of 2007) each lane carries 250 MB/s in each direction.

PCI Express External Cabling which extends the PCI Express interconnects architecture "outside the box." Cables using the PCIe technology will be used for external applications, as well as applications internal to an enclosure that need a cable connection. PCI Express External Cabling Specification, REV. 1.0 introduced four kinds of cable assemblies ×1, ×4, ×8 and ×16, and among which the ×16 cable assembly may reach highest transmitting rate. The ×16 cable assembly includes a housing, a pair of stacked PCBs accommodated in a space of the housing and four cables terminated to corresponding the PCBs. However, crosstalk phenomena between signals carried by the PCBs may affect signal property of a whole transmitting line.

Hence, an improved cable assembly is highly desired to overcome the aforementioned problems.

SUMMARY OF THE INVENTION

Accordingly, an object of the present invention is to provide a dual-interface electrical connector having anti-crosstalk means therebetween.

In order to achieve the object set forth, an electrical connector in accordance with the present invention comprises a housing including a first shield part assembled to a second shield part to form a receiving space, said receiving space including a hollow portion and a mating port located in front of the hollow portion;

a first and second printed circuit boards accommodated in the receiving space, both the first and second printed circuit boards having mating interfaces extending into the mating port and terminating portions located within the hollow portion; a spacer disposed between the first and second printed circuit boards; and a sheet metal enclosed in the spacer, and said sheet metal having two tabs formed thereon and electrically connected to the first and second printed circuit boards, respectively.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
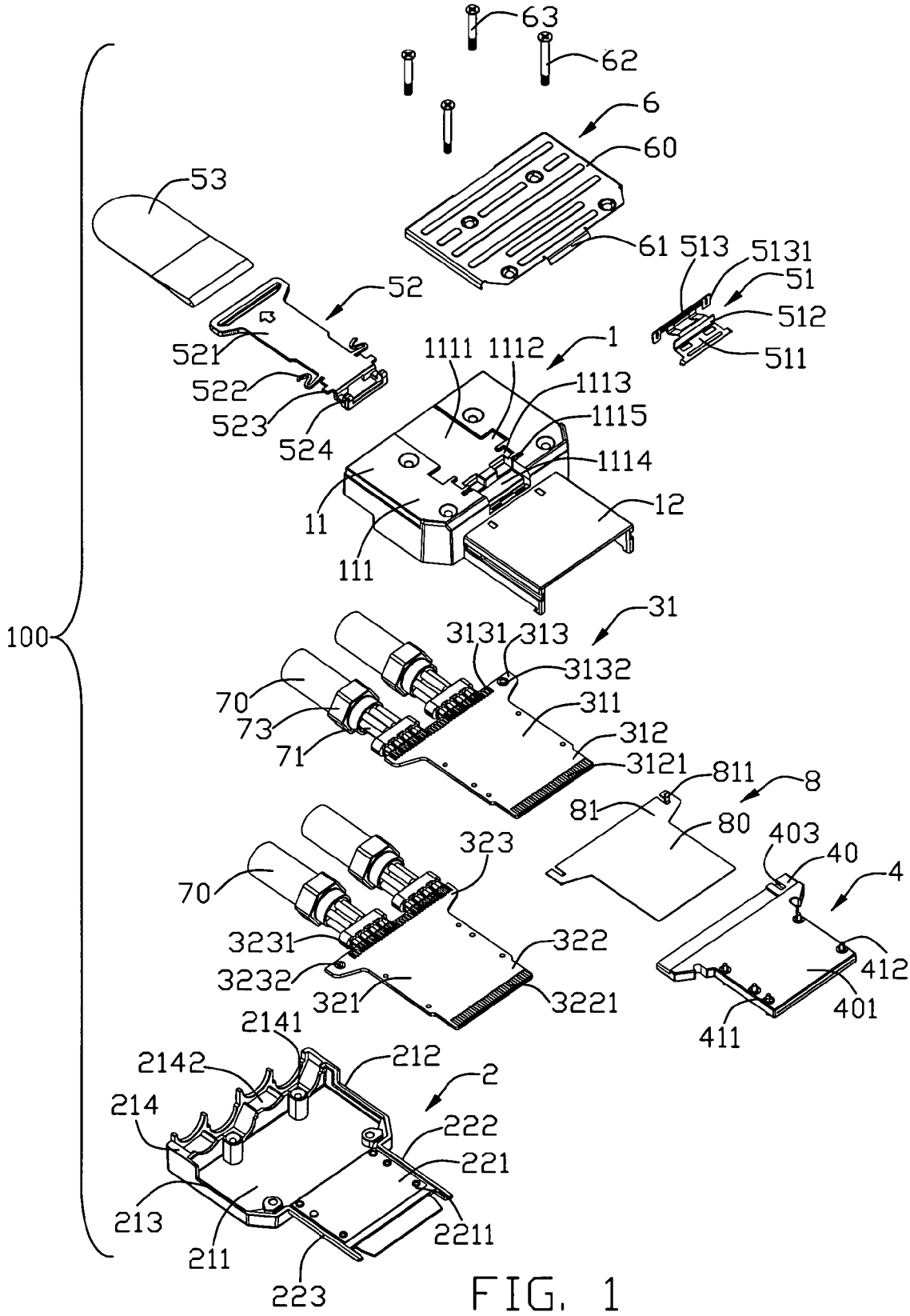
FIG. 1 is an exploded, perspective view of an electrical connector in accordance with the present invention.
Figure 2:
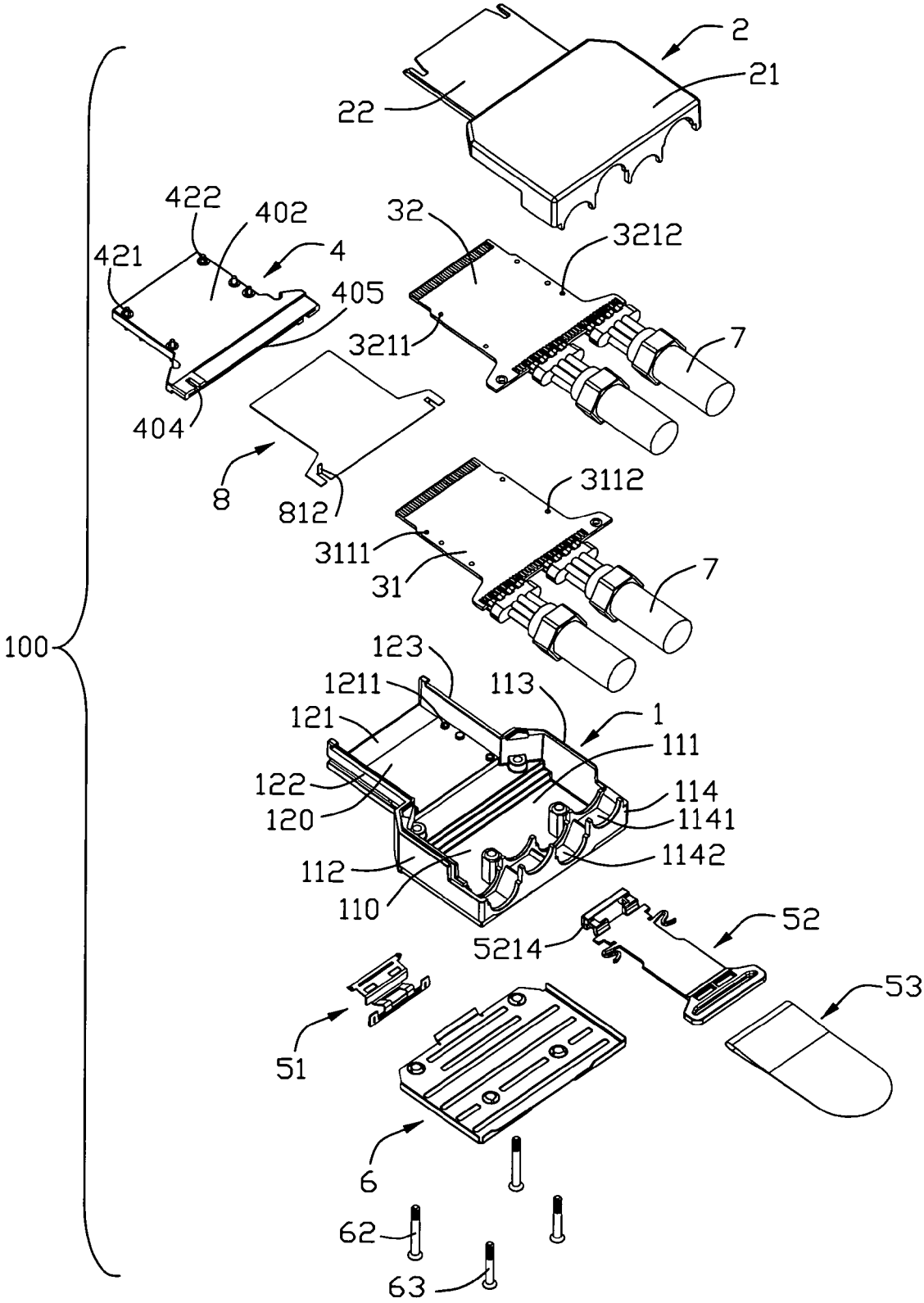
FIG. 2 is similar to FIG. 1, but viewed from another aspect.
Figure 3:
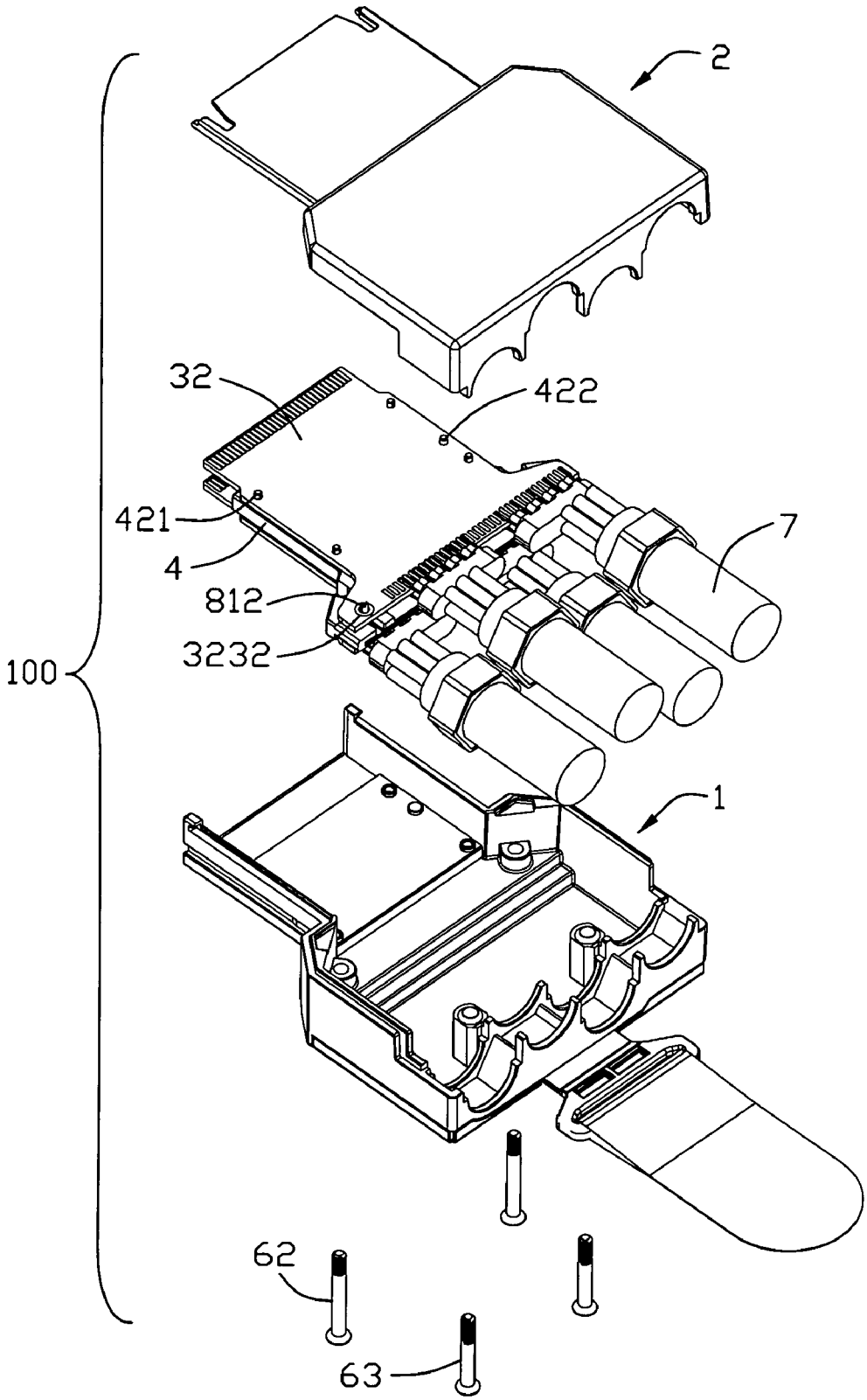
FIG. 3 is a partially assembled, perspective view of the electrical connector.
Figure 4:
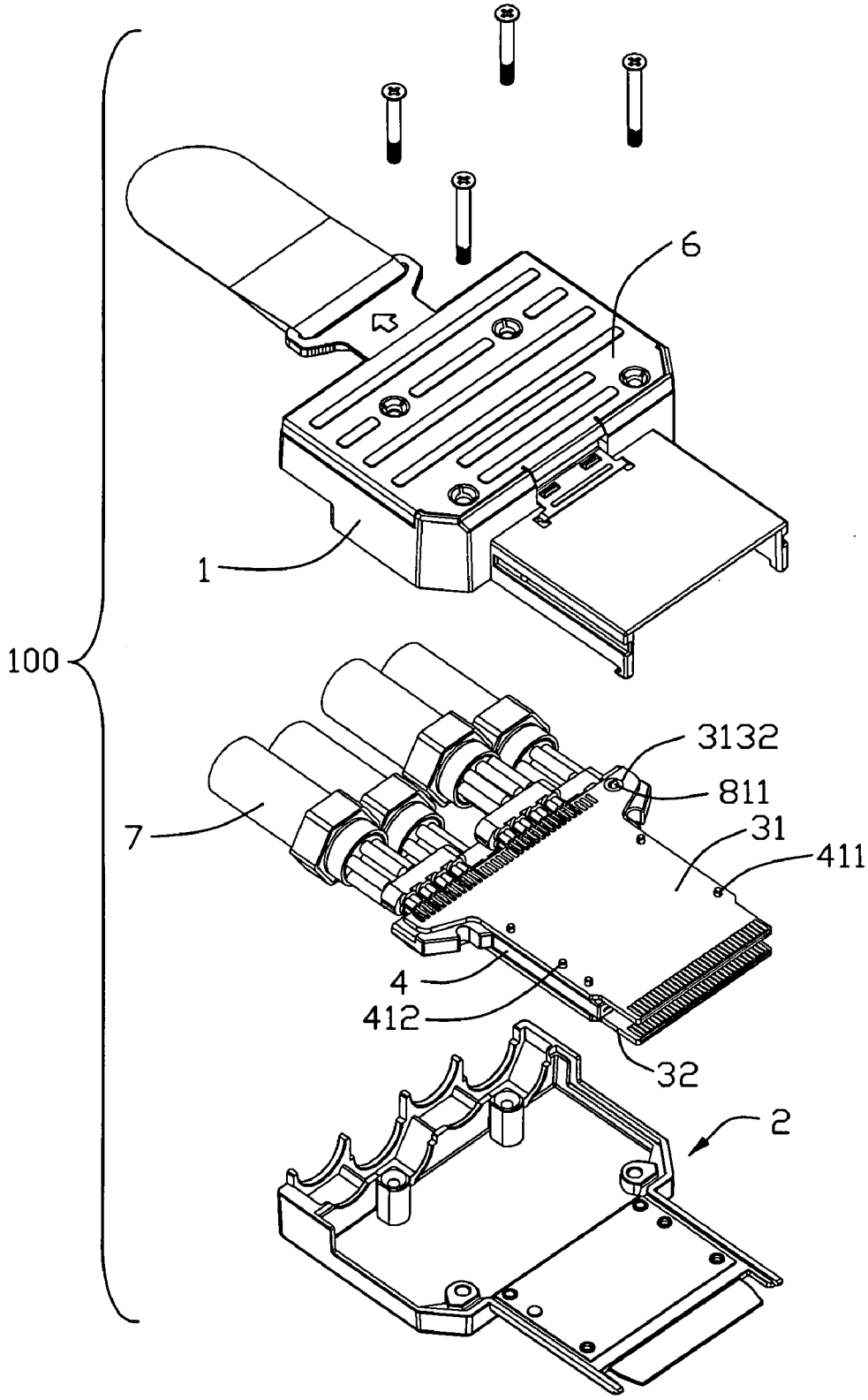
FIG. 4 is similar to FIG. 3, but viewed from another aspect.
Figure 5:
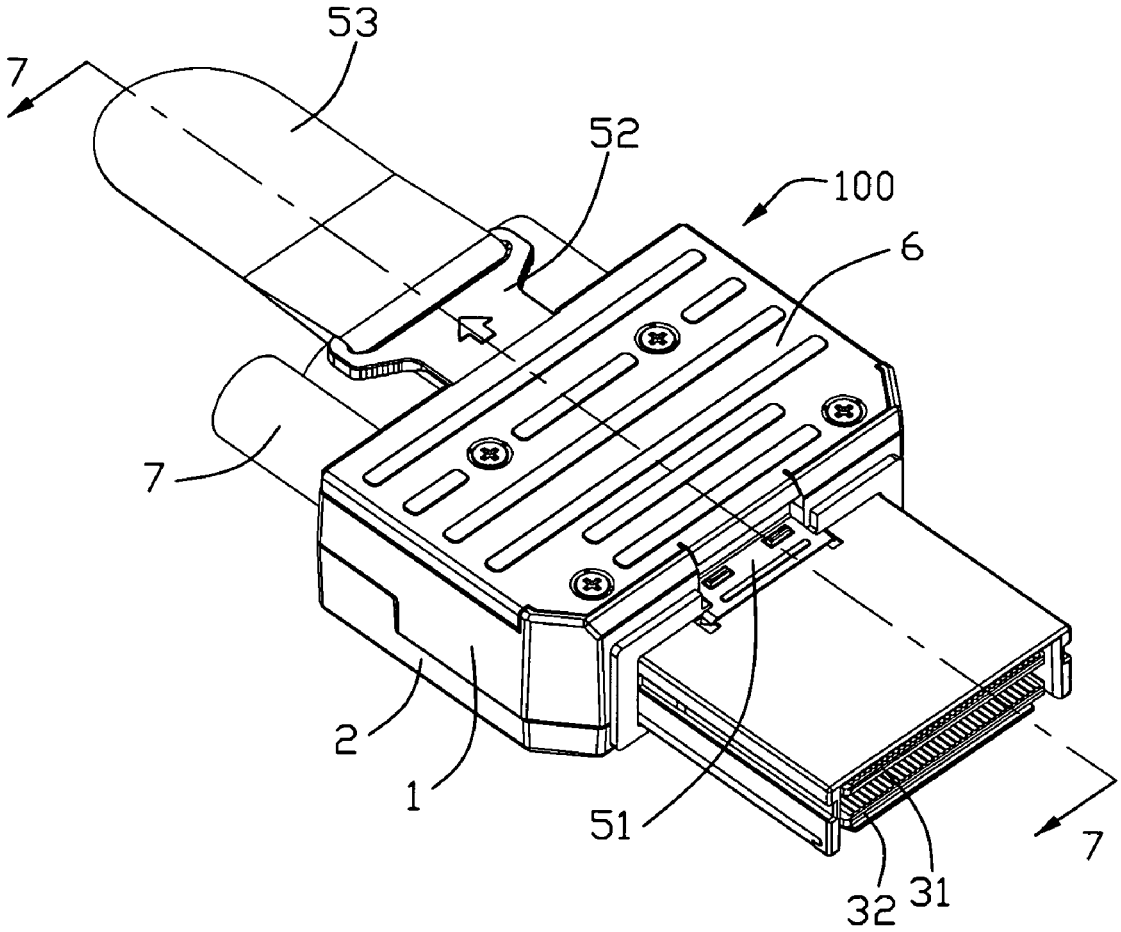
FIG. 5 is an assembled, perspective view of the electrical connector.
Figure 6:
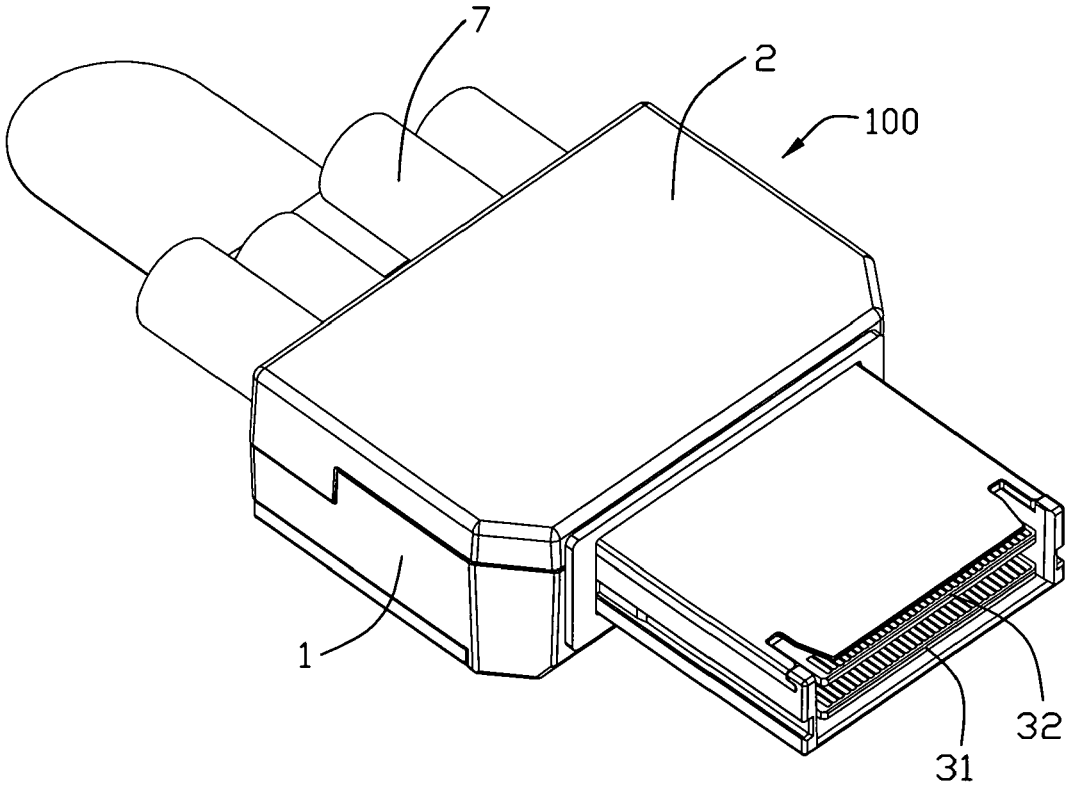
FIG. 6 is similar to FIG. 5, but viewed from another aspect.
Figure 7:
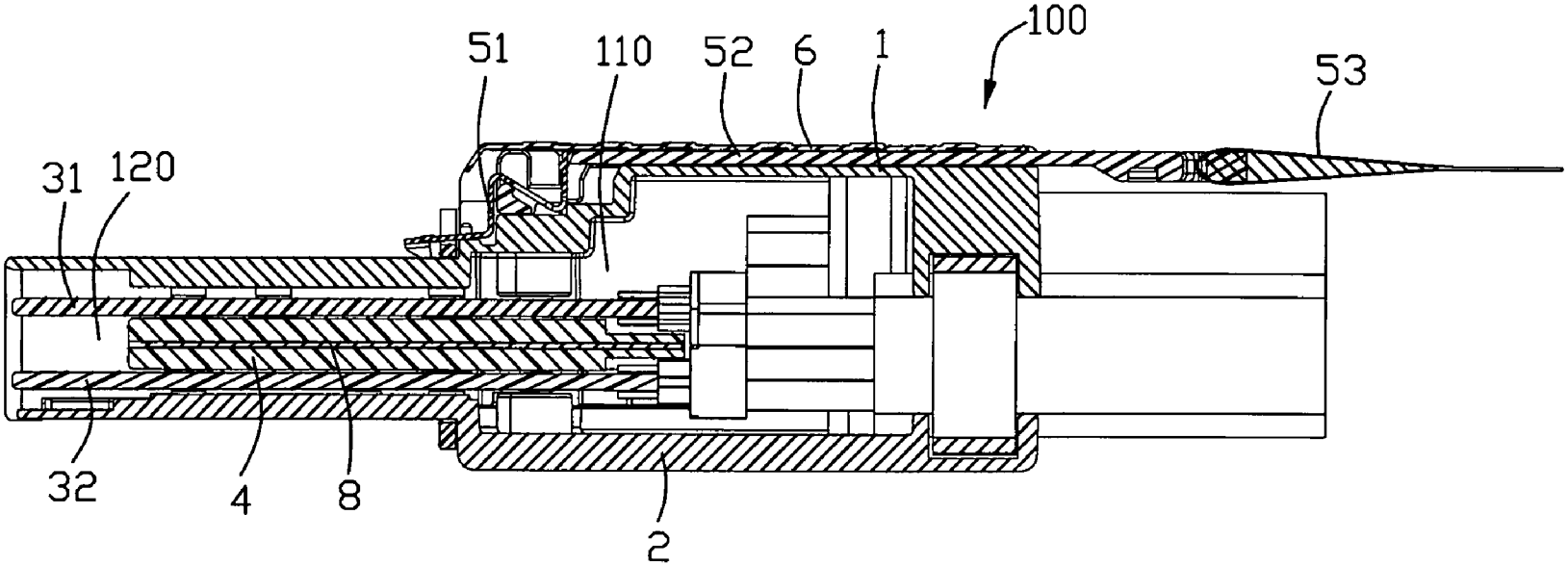
FIG. 7 is a cross-section view taken along line 7-7 of FIG. 5.

Referring to FIGS. 1-7, an electrical connector 100 in accordance with the present invention comprises a conductive housing having a first shield part 1 and a second shield part 2 together enclosing a receiving space (not numbered) therein, a first printed circuit board (PCB) 31 and a second PCB 32 accommodated in the receiving space, a spacer 4 disposed between the first PCB 31 and the second PCB 32, a metal sheet 6 enclosed in the spacer 4. The electrical connector 100 is adapted for connecting with four cables 7 which are divided into two groups and respectively coupled to the first PCB 31 and the second PCB 32.

The first shield part 1 comprises an expanded first base portion 11 and a relative slim first mating portion 12 extending forwardly from a front edge of the first base portion 11. The first base portion 11 has a top wall 111, a pair of side walls 112, 113 and a rear wall 114 together forming a hollow portion 110. Four cavities 1141, 1142 are defined in a rear wall 114. These four cavities 1141, 1142 may be separated into two groups, and the first group cavities includes a first and third cavities 1141 (or the odd numbered cavity), the second group cavities includes a second and a fourth cavities 1142 (or the even numbered cavity). The first cavity 1141 is shadow than the second cavity 1142. The first mating portion 12 has a top side 121, a pair of transversal sides 122, 123 forming a mating port 120 located in front of and communicating with the hollow portion 110. A number of support members 1211 are respectively arranged at lateral sides of the bottom side 121.

The upper portion of the top wall 111 defines a first channel portion 1111 arranged in a middle section thereof and a lower second channel portion 1114 in front of and communicating with the first channel portion 1111. A pair of first grooves 1112 are located in the middle section of the top wall 111 and further communicates with the first channel portion 1111. Two second grooves 1113 are in front of the first grooves 1112 and also communicates with the first channel portion 1111. A pair of slots 1115 are recessed downwardly from a top surface of a front section of the top wall 111 and communicate with the second channel portion 1114.

The second shield part 2 comprises a second base portion 21 and a second mating portion 22 extending forwardly from a front edge of the second base portion 21. The second base portion 21 has a bottom wall 211, a pair of side walls 212, 213 and a rear wall 214 extending upwardly from lateral edges and rear edge of the bottom wall 211. Four cavities 2141, 2142 are defined in a rear wall 214. The four cavities 2141, 2142 may be separated into two groups, and the first group cavities includes a first and third cavities 2141, the second group cavities includes a second and a fourth cavities 2142. The first cavity 2141 is deeper than the second cavity 2142. A structure of first or third cavity 2141 is same as the second or fourth cavity 1142 of the rear wall 114, and a structure of second or fourth cavity 2142 is same as the first or third cavity 1141 of the rear wall 114. The four cavities 1141, 1142 of the rear wall 114 cooperating with corresponding cavities 2141, 2142 of the rear wall 214 to form four cable exit outlets (not numbered). Therefore, the cable exit outlets are separated into two groups and further staggered in a rear wall (not numbered) of the housing 10. The second mating portion 22 has a bottom side 221, a pair of flanges 222, 223 formed at lateral edges of the bottom side 221. A number of support members 2211 are respectively arranged at lateral sides of the bottom side 221.

The first PCB 31 and the second PCB 32 have substantially identical shape. Both the first and second PCBs 31, 32 includes middle portions 311, 321, narrower front portions 312, 322 and broader rear portions 313, 323. A number of first conductive pads 3121 arranged on the front portion 312 to form a first mating interface and a plurality of second conductive pads 3131 arranged on the rear portion 313 to from a first terminating portion. The second conductive pads 3131 are proximate left side of the rear portion 313. An imaginary geometric central line (not shown) of the first conductive pads 3121 does not pass through geometric center of the set of second conductive pads 3131, thus the first conductive pads 3121 offset the set of second conductive pads 3131 along a longitudinal direction. A first via or plated hole 3132 is defined in the right side of the rear portion 313. Three first positioning holes 3111 are defined in the left side of the middle portion 311, and two second positioning holes 3112 are defined in the right side of the middle portion 311.

Similarly, a number of first conductive pads 3221 arranged on the front portion 322 to form a second mating interface and a plurality of second conductive pads 3231 arranged on the rear portion 323 to from a second terminating portion. The second conductive pads 3231 are proximate right side of the rear portion 323. An imaginary geometric central line (not shown) of the first conductive pads 3221 does not pass through geometric center of the second conductive pads 3231, thus the group of first conductive pads 3221 offset the set of second conductive pads 3231 along a longitudinal direction. Thus, when the first and second PCBs 31, 32 are accommodated in the space of the housing 10, the mating interface of the first PCB 31 align with the mating interface of the second PCB 32 along a vertical direction, while the terminating portion of the first PCB 31 offset the terminating portion of the second PCB 32 along a vertical direction. A second via or plated hole 3232 is defined in the left side of the rear portion 323. Two first positioning holes 3211 are defined in the left side of the middle portions 321, and three second positioning holes 3212 are defined in the right side of the middle portion 321.

The spacer 4 defines an upper surface 401 and an opposite lower surface 402. Three first positioning posts 411 extend upwardly from a left side of the upper surface 401 of a main portion of the spacer 4, and two second positioning posts 412 extend upwardly from a right side of the upper surface 401 of the main portion. Furthermore, two first positioning posts 421 extend downwardly from a left side of the lower surface 402 of the middle portion, and three second positioning 422 extend downwardly from a right side of the lower surface 402 of the middle portion. The spacer 4 further has a broader rear portion, with two wing parts 40 respectively projecting outward. A cavity 405 is recessed forwardly from a back surface of the rear portion of the spacer 4. A first slot 403 is defined in an upper section of the wing part 40 and communicated to the cavity 405, and a second slot 404 is defined in a lower section of the other wing part 40 and communicated to the cavity 405.

A latch mechanism 5 is assembled to the housing of the electrical connector 100. The latch mechanism 5 includes a latch member 51, an actuator 52 and a pull tape 53 attached to a rear portion of the actuator 52. The actuator 52 has a main body 521 received in the first channel portion 1111, a pair claw-shaped spring member 522 arranged at lateral sides of a front segment of the main body 521 and received in the first grooves 1112, a pair of stopper 523 disposed in front of the pair of claw-shaped spring member 522 and arranged at the lateral sides of the main body 521 and received in the second grooves 1113, an engaging portion 524 formed at a front end of the actuator 521 and received in the second channel portion 1114. The latch member 51 has a latch portion 511 disposed above first mating portion 12, an engage segment 513 attached to the first base portion 11, with a pair of ear portions 5131 thereof interferentially received in the pair of slots 1115 of the first base portion 11, an N-shaped interconnecting portion 512 disposed above the engaging portion 524 of the actuator 52.

Each of the cables 7 includes a number of wires 71 and an insulated jacket 70 enclosing thereon. A hexagon-shaped outer ring 73 is crimped to a front portion of the insulated jacket 70. The outer ring 73 is arranged into corresponding cavities 1141/1142 and 2141/2142 in the cable exit outlet of the rear wall to retain the cable 7 with the housing.

The metal sheet 8 has a substantially same outline as but a little smaller than the spacer 4 and includes a body portion 80 and a broader rear portion 81. A first tab 811 and a second tab 812 respectively project upwardly and downwardly from a right side and a left side of the rear portion 81. The metal sheet 8 is inserted into the cavity 405 of the spacer 4, with the first tab 811 and the second tab 812 respectively projected outside through the first slot 403 and the second slot 404 of the spacer 4.

When assembly, the wires 71 of the cables 7 are soldered to the second conductive pads 3131, 3231 of the first and second PCBs 31, 32, the first tab 811 and the second tab 812 are soldered to the first and the second conductive holes 3132, 3232, then the first PCB 31 and the second PCB 32 are respectively mounted to the spacer 4, with the first positioning posts 411 and the second positioning posts 412 which are arranged on the upper surface 401 inserted into the first positioning holes 3111 and the second positioning holes 3112, the first tab 811 inserted into the first via or plated hole 3132; the first positioning posts 421 and the second positioning posts 422 which are arranged on the lower surface 402 inserted into the first positioning holes 3211 and the second positioning holes 3212, the second tab 812 inserted into the second via or plated hole 3232. Therefore, the first and second PCBs 31, 32 are combined with the spacer 4.

Secondly, the first and the second PCBs 31, 32 are mounted to the first shield part 1, with the first and second mating interfaces thereof are disposed in the mating port 120, the first and second terminating portion thereof are accommodated in the hollow portion 110. Thirdly, the second shield part 2 is assembled to the first shield part 1. Fourthly, the latch mechanism 5 is assembled to the first shield part 1. Fifthly, a cap member 6 is assembled to the first shield part 1 to fix the latch mechanism 5, with a main portion 60 of the cap member 6 shielding the first base portion 11, a spring member 61 formed at a front edge thereof pressing onto the latch portion 511. A pair of first bolts 62 and a pair of second bolts 63 are assembled to the first and second shield parts 1, 2 to combine them together with the cap member 6. As the sets of second conductive pads 3131, 3231 of the first and second PCBs 31, 32 offset from one another, and cable exit outlets of the housing 10 are staggered and arranged at different levels, by such proper design, it is easily to arrange the cables 7 and the PCBs 3 in the limited space within the housing. Furthermore, a sheet metal 8 disposed between the first and second PCB 31, 32, and such precaution is capable of eliminating or preventing crosstalk therebetween.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising:

a housing including a first shield part assembled to a second shield part to form a receiving space, said receiving space including a hollow portion and a mating port located in front of the hollow portion;

a first and second printed circuit boards accommodated in the receiving space, both the first and second printed circuit boards having mating interfaces extending into the mating port and terminating portions located within the hollow portion;

a spacer disposed between the first and second printed circuit boards; and a sheet metal enclosed in the spacer, said sheet metal having two tabs electrically connected to the first and second printed circuit boards, respectively.

2. The electrical connector as recited in claim 1, wherein the two printed circuit boards are parallel to each other.

3. The electrical connector as recited in claim 1, wherein a cavity is recessed inwardly from a back surface of the spacer to accommodate the sheet metal.

4. The electrical connector as recited in claim 3, wherein two slots are respectively defined in an upper section and a lower section of a rear section of the spacer and in communication to the cavity, and the two tabs of the sheet metal respectively extend outside through the slots.

5. The electrical connector as recited in claim 4, wherein the two slots are arranged in opposite sides of the rear section of the spacer.

6. The electrical connector as recited in claim 4, wherein two plated holes are respectively defined in rear sections of the first and second printed circuit boards to receive the tabs of the sheet metal.

7. The electrical connector as recited in claim 6, wherein the tabs of the sheet metal are soldered to the plated holes.

8. The electrical connector as recited in claim 7, wherein each of the plated holes is arranged on a lateral side of the terminating portion of an associated printed circuit board.

9. The electrical connector as recited in claim 8, wherein the two slots offset from the terminating portions of the first and second printed circuit boards.

10. The electrical connector as recited in claim 1, wherein a plurality of positioning holes are defined in middle sections of the first and the second printed circuit boards, and corresponding positioning posts are formed on an upper or a lower surfaces of the spacer and inserted into the positioning holes.

11. The electrical connector as recited in claim 10, wherein the positioning holes are divided into two sets and located in a left and right sides of the middle sections of the first printed and second printed circuit board.

12. The electrical connector as recited in claim 11, wherein the number of the positioning holes in the left side is unequal to the number of the positioning holes in the right side of the same printed circuit board.

13. The electrical connector as recited in claim 11, wherein the number of the positioning holes in one of the sides of the first printed circuit board is unequal to the number of the positioning holes in the same side of the second printed circuit board.

14. The electrical connector as recited in claim 1, wherein a group of first conductive pads are arranged on a front segment of each printed circuit board to form the mating interface, and wherein a set of second conductive pads are arranged on the rear segment of each printed circuit board to form the terminating portion.

15. The electrical connector as recited in claim 14, wherein the mating interface of the first printed circuit board aligns with the mating interface of the second printed circuit board along a vertical direction.

16. The electrical connector as recited in claim 14, wherein the terminating portion of the first printed circuit board offsets the terminating portion of the second printed circuit board along a vertical direction.

17. An electrical connector adapted for connecting with at least two cables, comprising:

a housing including a first shield part assembled to a second shield part to form a receiving space, said receiving space including a hollow portion and a mating port located in front of the hollow portion;

a first and second printed circuit boards accommodated in the receiving space, both the first and second printed circuit boards having mating interfaces extending into the mating port and terminating portions located within the hollow portion;

a spacer disposed between the first and second printed circuit boards;

a sheet metal enclosed in the spacer, said sheet metal having two tabs electrically connected to the first and second printed circuit boards, respectively; and the cables respectively connected to rear portions of the first and second printed circuit boards.

18. The electrical connector as recited in claim 17, wherein two vias are respectively defined in the rear portions of the first and second printed circuit boards to accommodate the two tabs of the sheet metal.

19. An electrical connector assembly comprising:

a casing defining a receiving cavity;

vertically aligned upper and lower printed circuit boards respectively located at upper and lower levels while commonly received in the receiving cavity in a parallel relation with each other;

upper and lower cables offset from each other vertically to be located at the upper and the lower levels, respectively, and further offset from each other horizontally to connect to different positions of the corresponding upper and lower printed circuit boards in a transverse direction so as to have the whole assembly in a dense arrangement without interference;

wherein a metallic shield is located between the upper printed circuit board and the lower printed circuit board and defines a pair of tags respectively engaged with the upper and lower printed circuit boards, respectively;

wherein said metallic shield is disposed in an insulator sandwiched between the upper and lower printed circuit boards.

* * * * *